US011376884B2

(12) United States Patent
Imai et al.

(10) Patent No.: US 11,376,884 B2
(45) Date of Patent: Jul. 5, 2022

(54) BINDER

(71) Applicant: Kenkousya ltd., Tokyo (JP)

(72) Inventors: Yuhei Imai, Tokyo (JP); Yuzo Hayashi, Tokyo (JP); Hirozumi Fujiwara, Tokyo (JP)

(73) Assignee: KENKOUSYA LTD.

( * ) Notice: Subject to any disclaimer, the term of this patent is extended or adjusted under 35 U.S.C. 154(b) by 0 days.

(21) Appl. No.: 17/225,957

(22) Filed: Apr. 8, 2021

(65) Prior Publication Data

US 2021/0323340 A1 Oct. 21, 2021

(30) Foreign Application Priority Data

Apr. 15, 2020 (JP) ..... JP2020-073108
Oct. 8, 2020 (JP) ..... JP2020-170674

(51) Int. Cl.
*B42F 1/00* (2006.01)

(52) U.S. Cl.
CPC ..... *B42F 1/006* (2013.01)

(58) Field of Classification Search
CPC .... B42F 1/006; B42F 1/02; B42F 9/00; B42F 9/008; B42F 11/00
See application file for complete search history.

(56) References Cited

U.S. PATENT DOCUMENTS 2,259,505 A * 10/1941 Wisdom ..... B42F 1/006 24/67.5
2,741,495 A * 4/1956 Gould ..... B42F 9/00 281/19.1
3,460,282 A * 8/1969 Swirsky ..... C04B 41/60 40/530
4,402,530 A * 9/1983 Daguerre ..... B42F 9/00 281/45
4,575,123 A * 3/1986 Giblin ..... B42B 5/06 281/48
5,539,963 A * 7/1996 Fujiwara ..... B42F 1/006 24/536
5,619,789 A * 4/1997 Chung ..... B25B 31/00 24/67 R
6,270,120 B1 * 8/2001 Ong ..... B42D 1/06 281/15.1

(Continued)

FOREIGN PATENT DOCUMENTS

JP H9-150593 6/1997 ..... B42F 1/02
JP 2004-330437 11/2004 ..... B42F 9/00

*Primary Examiner* — Robert Sandy
*Assistant Examiner* — Louis A Mercado
(74) *Attorney, Agent, or Firm* — Hayes Soloway P.C.

(57) ABSTRACT

A binder forming a booklet by bundling end portions of a plurality of sheets of paper such that paper addition or removal is possible includes a spread-shaped front cover member configured for sandwiching a bundle of the plurality of sheets of paper, a long cover member having an opening portion along a back portion of the front cover member, and a plurality of clips arranged so as to be configured for moving forward and backward in the opening portion of the cover member and having a pair of holding pieces and claw portions respectively extending inward from tips of the holding pieces. Through holes through which the claw portions of the plurality of clips are respectively inserted are formed in each of front and back covers of the front cover member.

16 Claims, 16 Drawing Sheets

(56) References Cited

U.S. PATENT DOCUMENTS

| | | | | |
|---|---|---|---|---|
| 7,500,301 | B2 * | 3/2009 | Cassaday | B42F 1/00 24/328 |
| 8,714,596 | B1 * | 5/2014 | Bloomberg | B42B 4/00 281/27.3 |

* cited by examiner

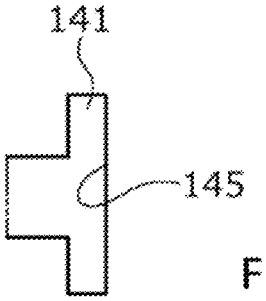
Fig. 10(a)
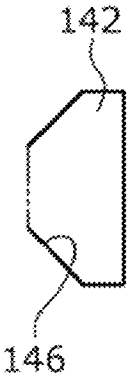
Fig. 10(b)
Fig. 10(c)
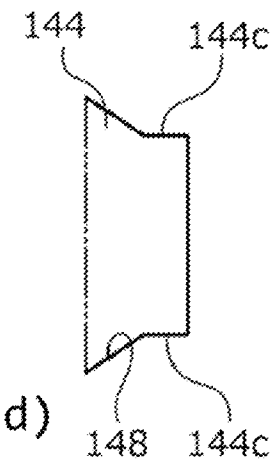
Fig. 10 (d)

BINDER

BACKGROUND OF THE INVENTION

Field of the Invention

The present invention relates to a binder used to form a booklet by bundling end portions of a plurality of sheets of paper.

Description of the Related Art

A booklet such as a notebook and a book is formed by end portions of a plurality of sheets of paper being bound by means of glue, a thread, or the like. In addition, a user may form a booklet by binding a plurality of sheets of paper in order to classify and organize documents or the like as needed. In the related art, so-called ring files and the like have been often used in such a case. For example, a ring file is provided with a front cover folded in half and an annular fastening tool as holding means for holding a plurality of sheets of paper on the back surface of the front cover, a through hole in a document is formed by means of a punch or the like, the annular fastening tool is inserted through the through hole, and then paper can be added or removed as needed.

In addition, the binder that is illustrated in JP 2004-330437 A (Page 1, FIG. 1) includes a long cover member disposed along the back portion of a front cover and the cover member is provided with a clip as holding means. This clip is a technique known in the related art as illustrated in JP H9-150593 A (Page 3, FIG. 1). The clip of JP H9-150593 A (Page 3, FIG. 1) is formed by an elastic and metallic thin plate being folded and is formed in a substantially U shape in side view and so as to open in the front cover direction with a pair of facing holding pieces extending from the short-direction end portion of a base portion. The pair of holding pieces are formed so as to spread ahead in the opening direction. At the tips of the holding pieces, pressing claws facing each other are respectively formed so as to be folded inward to the base portion side. In binding paper, the bundle of a plurality of sheets of paper is slid and pushed into a pressing member having a U shape in side view with the bundle of a plurality of sheets of paper inserted between the pair of holding pieces of the clip. As a result, the pair of holding pieces are pinched in the pressing member and the sheet bundle can be strongly pressed by the return elastic force of the pair of pressing claws compressed between the holding piece and the sheet bundle. By means of such a clip, a document can be bound in a booklet shape without through hole formation in the document.

In addition, in releasing the holding by means of the clip, the sheet bundle and the pressing member may be respectively grasped and pulled in a direction of separation. In the initial stage of pulling the sheet bundle and the pressing cover portion in the direction of separation, the pressing claws of the clip are respectively pressed against the front surface of the paper on the uppermost surface and the back surface of the paper on the lowermost surface against which the pressing claws directly abut. Then, the frictional force that acts on the point of mutual abutment prevents the front and back surfaces of the sheet bundle from moving relative to each other. Accordingly, the sliding of the opening inner surface of the pressing member and the surface of the holding piece of the clip causes the pressing member and the clip to operate so as to be relatively separated from each other, the pinching pressure of the holding piece of the clip is attenuated with the separation, and the clip-based holding can be released through a simple operation.

Returning to JP 2004-330437 A (Page 1, FIG. 1), in this binder, three separate clips are arranged in the longitudinal direction of the long cover member. In addition, in JP 2004-330437 A (Page 1, FIG. 1), a spread-shaped front cover member is provided for the purpose of paper protection and appearance improvement. In this configuration, a bundle of a plurality of sheets of paper is held and bound by the three clips and over the front cover member in a state where the bundle of a plurality of sheets of paper is sandwiched between the front cover members.

In releasing the clip-based holding in the clip file of JP 2004-330437 A (Page 1, FIG. 1), the sheet bundle is grasped with one hand from above the front cover member, the cover member is grasped with the other hand, and pulling is performed in a direction of separation. In a case where the front cover member is formed of a synthetic resin or the like and the coefficient of friction of the surface thereof is low at this time, the pressing claw of the clip slides on the surface of the front cover member and the clip is separated from the front cover member and the sheet bundle without the clip and the cover member being relatively separated from each other. Accordingly, the clip is forcibly removed from the front cover member and the sheet bundle with the force of holding by the holding piece unattenuated. Then, the sheet bundle may collapse. In addition, the clip removed from the front cover member and the sheet bundle remains stored in the cover member, and thus the clip portion that is stored needs to be pulled out once to the front side during sheet bundle re-binding, which has resulted in an increase in the complexity of paper addition or removal.

SUMMARY OF THE INVENTION

The present invention has been made in view of such a problem, and an object of the present invention is to provide a binder capable of smoothly adding or removing paper bound in a booklet shape regardless of the material of a front cover member.

In order to solve the above problem, a binder according to the present invention, which is a binder forming a booklet by bundling end portions of a plurality of sheets of paper such that paper addition or removal is possible, includes: a spread-shaped front cover member configured for sandwiching a bundle of the plurality of sheets of paper; a long cover member having an opening portion along a back portion of the front cover member; and a plurality of clips arranged so as to be configured for moving forward and backward in the opening portion of the cover member and having a pair of holding pieces and claw portions respectively extending inward from tips of the holding pieces, in which through holes through which the claw portions of the plurality of clips are respectively inserted are formed in each of front and back covers of the front cover member. According to the aforesaid feature of the present invention, the claw portions of the plurality of clips are inserted through the through holes formed in the front cover member and directly abut against the front surface of the paper on the uppermost surface and the back surface of the paper on the lowermost surface, respectively. Accordingly, when the bundle of a plurality of sheets of paper is grasped from above the front cover and the sheet bundle and the cover member are pulled so as to be separated from each other, the frictional force that acts on the point where the claw portion and the sheet bundle abut against each other causes the cover member and the plurality of clips to operate so as to be relatively separated from each other without the clip and the sheet bundle moving relative to each other. Then, the pinching pressure of the holding pieces of the plurality of clips is attenuated during one operation with the separation. In addition, the plurality of clips are pulled out of the opening portion of the cover member and the holding force is attenuated, and thus paper can be easily re-inserted into the internal space of the clip. In this manner, the work of adding or removing paper bound in a booklet shape can be smoothly performed regardless of the material of the front cover member.

It may be preferable that the plurality of clips is constituted by two clips and the clips are arranged near a longitudinal middle of the cover member. According to this preferable configuration, the clip is arranged near the middle of the long cover member. Accordingly, in a case where a bundle of a plurality of sheets of paper and the cover member are inclined and pulled so as to be separated from each other, the clip positioned on one longitudinal side away from the tilting fulcrum is moved so as to be separated to a large extent from the cover member. The clip positioned on the other longitudinal side near the tilting fulcrum is also moved in the direction of separation by following the clip on one side and the holding force of both clips can be attenuated by one operation.

It may be preferable that a dimension from the tip to a rear end of the holding piece of the clip and a dimension from the back portion of the front cover member to an edge portion of the through hole on a side of the back portion are substantially equal to each other. According to this preferable configuration, when the cover member and the front cover member are moved in a direction of separation, the inner corner portion that is the boundary between the holding piece and the claw portion and the back portion-side edge portion of the through hole abut against each other, the clip moves together with the front cover member, and the clip can be reliably pulled out of the opening portion of the cover member.

It may be preferable that a decorative member externally fittable to the cover member is detachably arranged on the cover member. According to this preferable configuration, the booklet bound to the binder is easily identified by means of the decorative member externally fitted to the cover member.

It may be preferable that a front-rear directional dimension of the through hole is smaller than a front-rear directional dimension of the claw portion. According to this preferable configuration, the claw portion inserted through the through hole is unlikely to escape from the through hole and excellent operability is achieved.

It may be preferable that the cover member has a flap extending toward a tip side from a back portion side of the through hole and a locking portion protruding inward in upper and lower edge portions of the holding piece of the clip. According to this preferable configuration, the upper and lower edge portions of the flap are disposed between the upper and lower locking portions of the clip, and thus the up-down-direction movement of the clip with respect to the front cover member is regulated.

It may be preferable that the flap is provided with a fold portion in a front-rear-direction middle portion. According to this preferable configuration, the fold portion functions as a cushioning portion to improve the durability of the flap with respect to the relative movement of the clip and the front cover member, that is, the repeated insertion and removal of the holding object.

BRIEF DESCRIPTION OF THE DRAWINGS

FIGS. 10A to 10D are diagrams illustrating a modification example of the shapes of the through hole and the flap in the first embodiment.

FIG. 13A is a diagram illustrating a state where the clip protrudes from the cover member to weaken the holding state of the claw portion. FIG. 13B is a diagram illustrating an aspect in which the back portion-side edge portion of the through hole of the front cover abuts against the inner corner portion of the clip. FIG. 13C is a diagram illustrating the storage release state where the clip is completely pulled out of the cover member.

DESCRIPTION OF THE PREFERRED EMBODIMENTS

A mode for carrying out the binder according to the present invention will be described below based on embodiments.

First Embodiment

Figure 1:
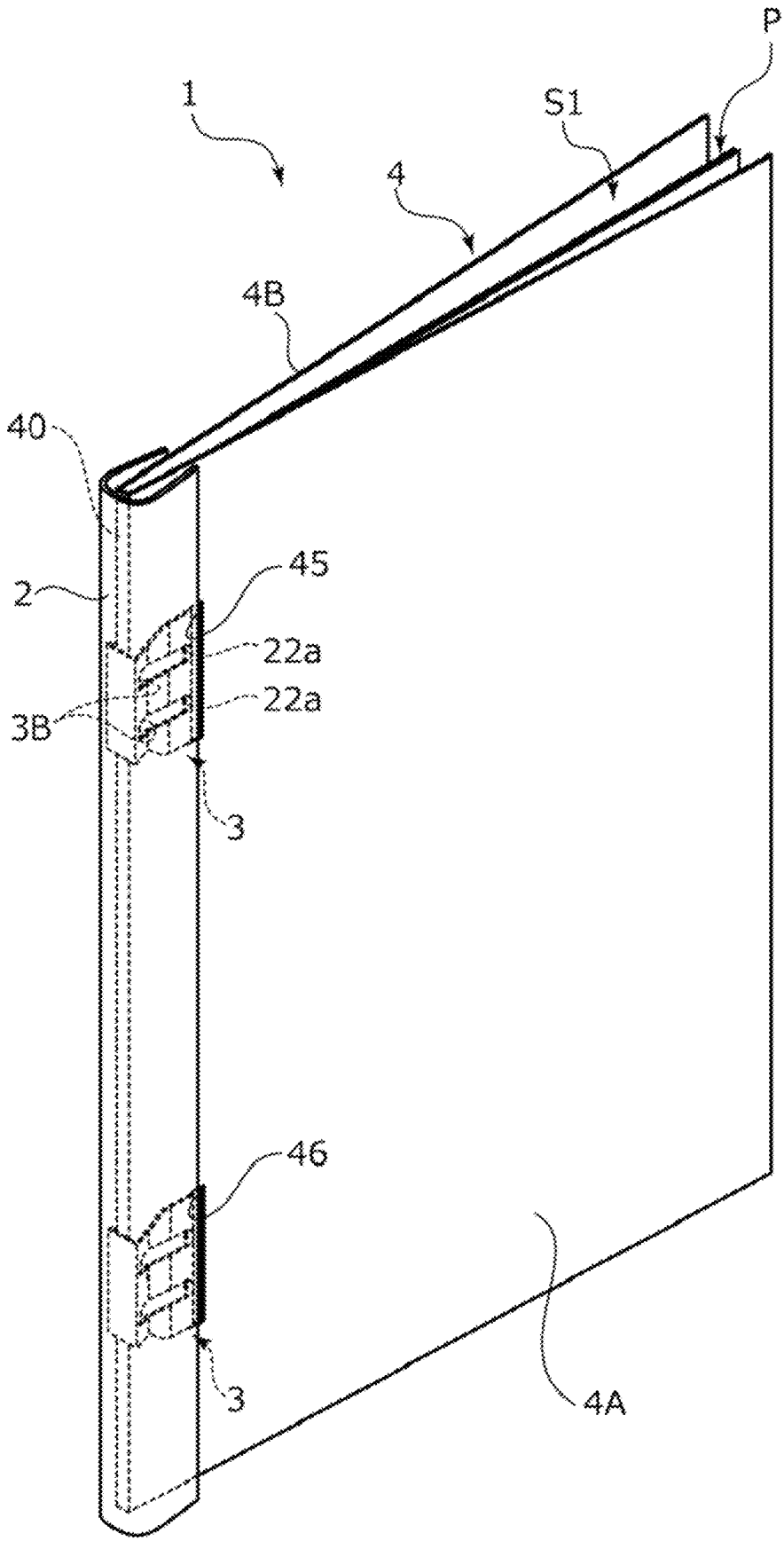
FIG. 1 is a perspective view illustrating the binder and the holding object according to a first embodiment of the present invention.

The binder according to a first embodiment of the present invention will be described with reference to FIGS. 1 to 11. In the following description, the upper right side of the plane of FIG. 1 is the front side. The following description is with reference to the up-down, right-left, and front-rear directions that are viewed from the front side.

Figure 2:
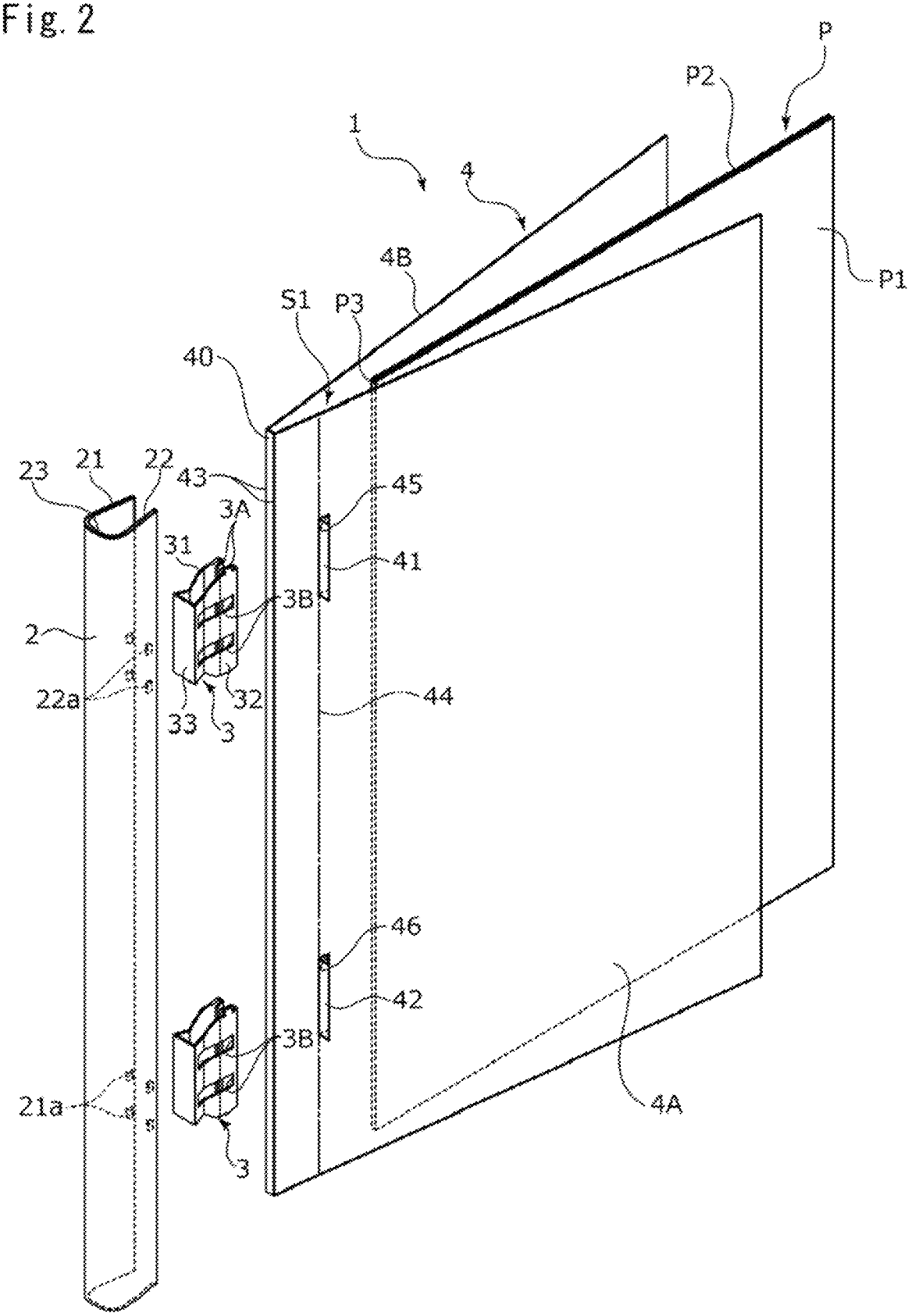
FIG. 2 is a perspective view illustrating an aspect in which the holding object is held by means of the binder in the first embodiment.

As illustrated in FIGS. 1 and 2, a binder 1 according to the example of the present invention is a filing tool for removably holding a holding object P inserted in an internal space S1 of the binder 1 and binding it in a booklet shape. The binder 1 is long and extends in the up-down direction. The binder 1 includes a cover member 2 having a substantially U-shaped cross section with its front surface (upper right in FIG. 1) open in the longitudinal direction, two clips 3 and 3 built in the cover member 2 in an engagement state and arranged apart from each other in the longitudinal direction, and a spread-shaped front cover member 4 covering the holding object P.

The holding object P that can be bound by the binder 1 is a paper leaf such as a letter and a memo, another sheet, a booklet, a document, or the like. In this example, the holding object P is a bundle of A4 copy paper.

Figure 3:
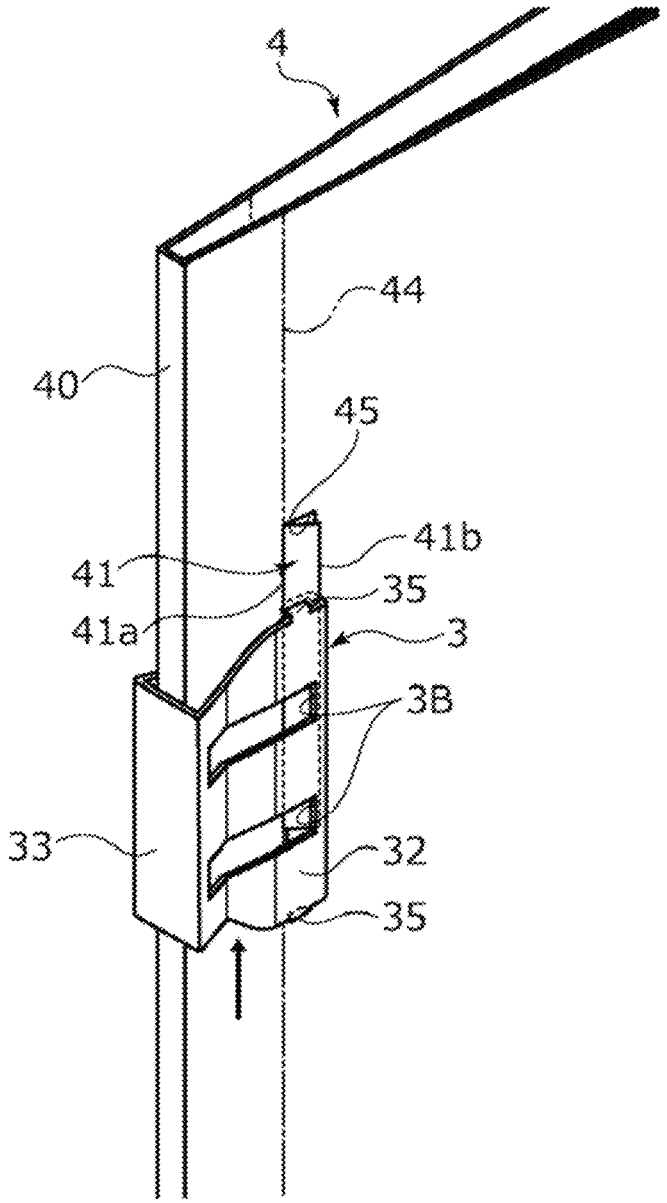
FIG. 3 is a perspective view illustrating how a clip is attached to a flap of a front cover in the first embodiment.
Figure 6:
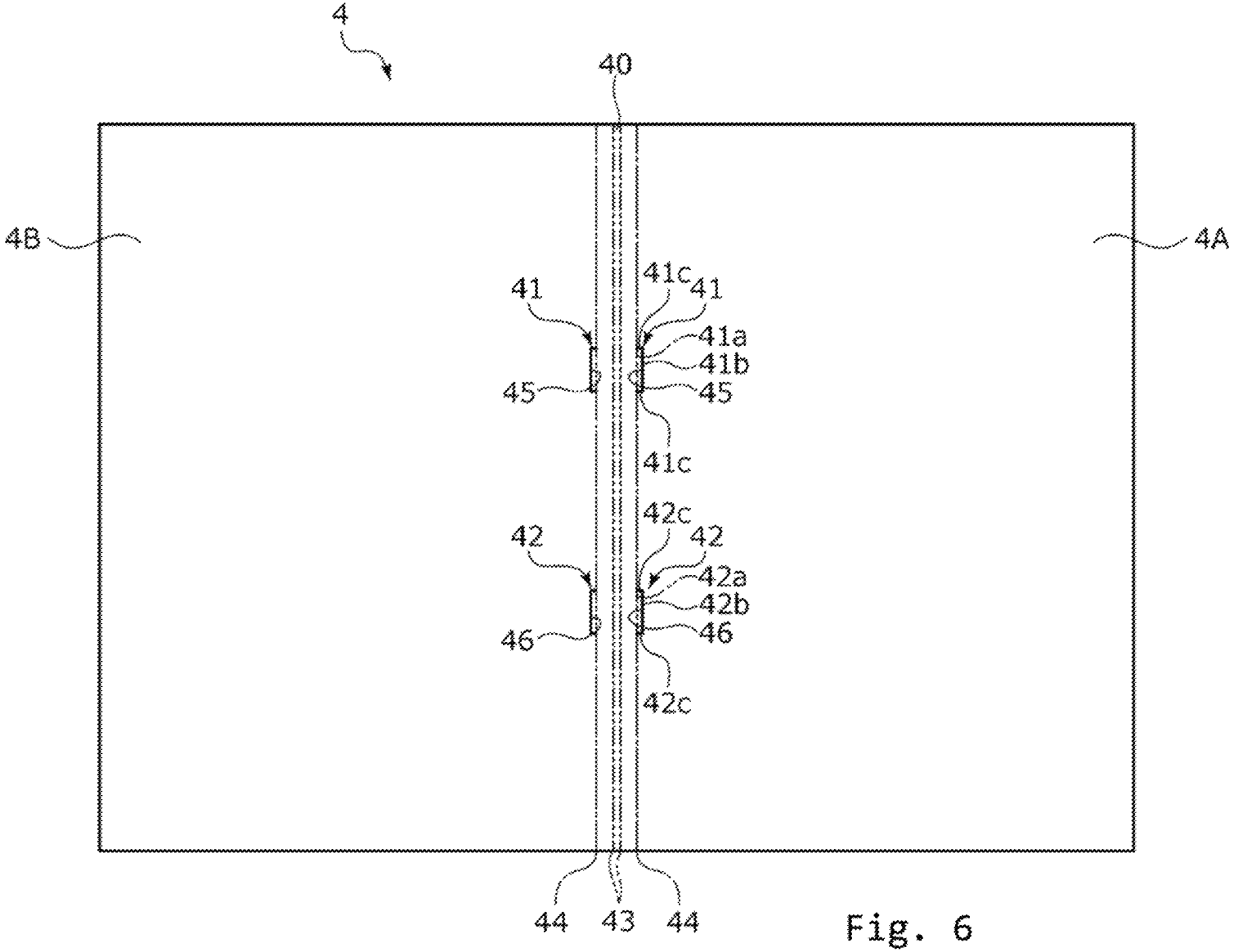
FIG. 6 is a plan view illustrating an aspect in which the front cover in the first embodiment is unfolded.

As illustrated in FIGS. 3 and 6, the front cover member 4 is configured as a deformable sheet made of, for example, polypropylene, polyethylene terephthalate, another elastic resin, paper, or the like. Fold portions 43 and 43 parallel to each other are formed so as to extend in the up-down direction substantially in the lateral middle of the front cover member 4 that is unfolded. Partitioned by the fold portions 43 and 43, a back portion 40 having a lateral width is formed between the fold portions 43 and 43. A front cover 4A and a back cover 4B are formed on both sides of the back portion 40. In addition, fold portions 44 and 44 are formed on both outer sides of the fold portions 43 and 43 and the front cover 4A and the back cover 4B are easy to fold in the valley fold direction.

Through holes 45 and 46 having the same shape are formed in each of the front cover 4A and the back cover 4B of the front cover member 4. The through holes 45 and 46 are formed near the middle of the front cover member 4 in the up-down direction. Specifically, taking the through hole 45 as an example, the through hole 45 is formed in a rectangular shape by the front cover 4A of the front cover member 4 being cut in a U shape with one side on the back portion side left and by the one side on the back portion side and the three sides forming the U shape. In other words, the through hole 45 has a flap 41 extending from the edge portion of the through hole 45 on the back portion side toward the edge portion of the through hole 45 on the tip side. The flap 41 has the same outer shape as the through hole 45 and is formed so as to block the through hole 45. In addition, the flap 41 is capable of swinging from one side 41*a* on the back portion side. Likewise, a flap 42 is formed in the through hole 46.

The through holes 45 and 46 of the front cover 4A and the through holes 45 and 46 of the back cover 4B are respectively formed at symmetrical positions with respect to the back portion 40 in the vicinity of the back portion 40.

The one side 41*a* on the back portion side of the flap 41 is positioned on the same line as the fold portions 44 and 44 of the front cover 4A and the back cover 4B. The flap 41 is raised in the valley fold direction, that is, such that one side 41*b* on the tip side faces the outside and the flap 41 is swingable inward and outward.

As illustrated in FIGS. 2, 3, and 7A to 7C, the clip 3 is a fastening tool formed so as to be elastically deformable, is mainly formed of a metal, a hard synthetic resin, or the like, and is shaped so as to open to one side from a base portion 33, holding pieces 31 and 32, and a pair of claw portions 3A and 3A. Specifically, the base portion 33 is formed and the holding pieces 31 and 32 are formed so as to be continuous and spread out from both ends thereof. Further, at the tips of the holding pieces 31 and 32, the claw portions 3A and 3A extending inward toward the base portion 33 are formed so as to face each other. In addition, locking portions 35 and 35 extend toward the facing (inward) direction on the middle sides of the upper and lower end edges of the holding pieces 31 and 32, respectively.

Next, an aspect in which the clip 3 is attached to the front cover member 4 will be described with reference to FIG. 3. First, the clip 3 is installed so as to sandwich the back portion 40 side of the front cover member 4 at a position where it does not overlap the through hole 45 and the flap 41 in the front-rear direction. Then, as illustrated in FIG. 3, the clip 3 is overlapped with the through hole 45 and the flap 41 by being slid in the up-down direction (here, upward). The flaps 41 and 41 are in a state where the one side 41*b* on the tip side is raised outward by the fold portions 44 and 44 of the front cover 4A and the back cover 4B. By the clip 3 being slid in the up-down direction, the flaps 41 and 41 are guided inside the claw portions 3A and 3A of the clip 3, respectively.

Figure 4:
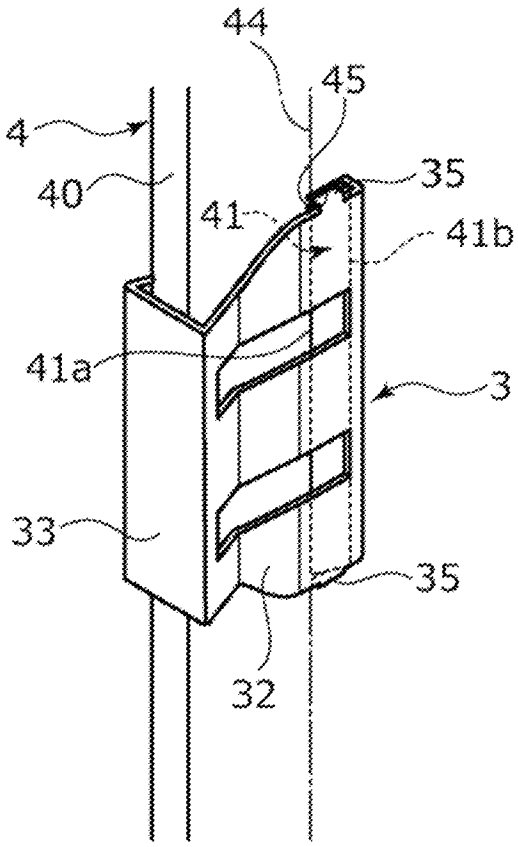
FIG. 4 is a partially enlarged perspective view illustrating an aspect in which the clip and the flap of the front cover are locked in an up-down direction in the first embodiment.
Figure 5:
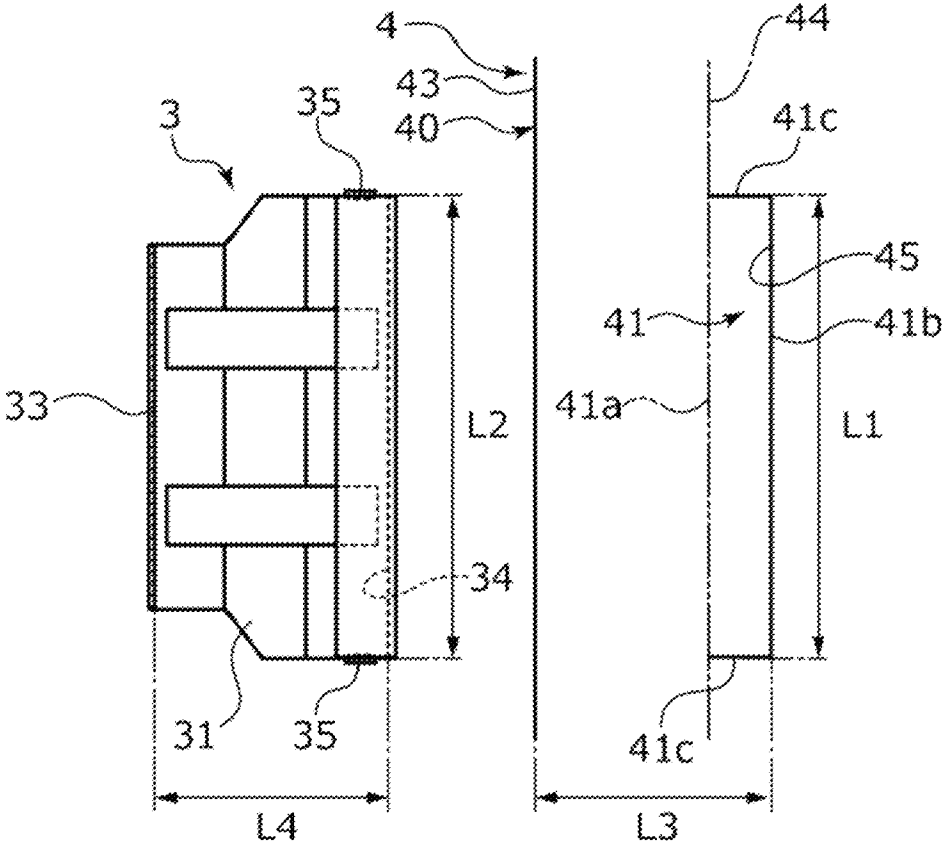
FIG. 5 is a partially enlarged view illustrating the dimensional relationship between the clip and the flap of the front cover in the first embodiment.

As illustrated in FIGS. 4 and 5, a dimension L1 between upper and lower edge portions 41*c* and 41*c* of the flap 41 is substantially equal to a separation distance L2 between the upper and lower locking portions 35 and 35 in the clip 3. The up-down-direction movement of the clip 3 with respect to the front cover member 4 is regulated by the upper and lower edge portions 41*c* and 41*c* of the flap 41 being disposed between the upper and lower locking portions 35 and 35 of the clip 3.

As illustrated in FIG. 5, a dimension L3 between the fold portion 43 of the front cover member 4 and the one side 41*b* on the tip side of the flap 41 is substantially equal to a separation dimension L4 to an inner corner portion 34 of the claw portion 3A from the base portion 33 of the clip 3 in the natural state and the front-rear-direction movements of the clip 3 and the front cover member 4 are regulated. It should be noted that the flap 41 is swingable from the fold portion 44 and deformable so as to bend by having a thin plate shape as illustrated in FIGS. 7A to 8B and thus the relative movement of the clip 3 and the front cover member 4 can be allowed by the swing or deformation of the flaps 41. In other words, the amount by which the relative movement of the clip 3 and the front cover member 4 is allowed is defined by the swing and deformation allowances of the flaps 41.

As illustrated in FIGS. 2 and 7A to 7C, the cover member 2 is formed of a metal, a hard synthetic resin, or the like so as to be less deformable than the clip 3 and a pair of pressing pieces 21 and 22 are formed on the tip side thereof with a substantially U-shaped cross section and across a base portion 23. The outer surface side of the base portion 23 functions as a back cover and a seal or the like is stickable. In addition, the insertion width of the inner side that is formed between the tips of the pair of pressing pieces 21 and 22 is smaller than the width of the outer side of the base portion 33 of the clip 3.

In addition, engagement protrusions 21*a* and 22*a* are formed so as to protrude on the inside surfaces of the pressing pieces 21 and 22 of the cover member 2 and engagement recesses 3B and 3B (see FIGS. 1 and 2), which are slits, are formed in the holding pieces 31 and 32 of the clip 3. The engagement protrusions 21*a* and 22*a* of the pressing pieces 21 and 22 and the engagement recesses 3B and 3B of the holding pieces 31 and 32 are fitted loosely, and the cover member 2 and the clips 3 and 3 are slidable and retained. The cover member 2 is attached to the clip 3 such that the inside surfaces of the pressing pieces 21 and 22 are slidable and relatively movable in the insertion (proximity) and removal (separation) directions of the holding object P along the outer surfaces of the holding pieces 31 and 32 of the clip 3.

Figure 7A:
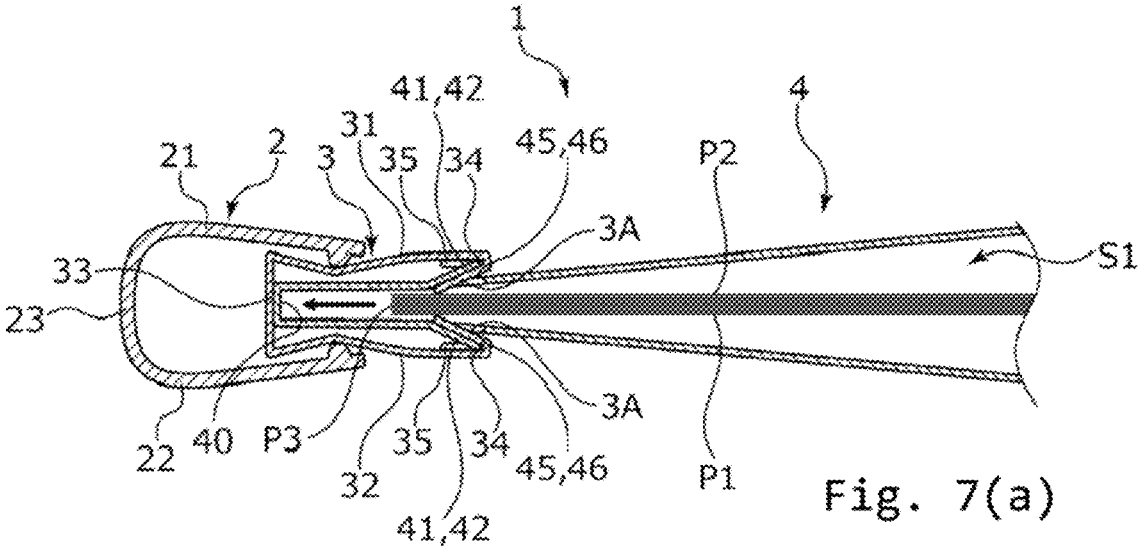
FIG. 7A is a diagram illustrating a storage release state where the clip is completely pulled out of a cover member in the first embodiment.

Next, an aspect in which the holding object P is held by the binder 1 will be described with reference to FIGS. 7A to 7C. First, as illustrated in FIG. 7A, the holding object P as a bundle of a plurality of stacked sheets of paper is grasped and inserted into the internal space S1 formed by the front cover 4A and the back cover 4B facing each other in the front cover member 4. Specifically, a binding end portion P3 of the holding object P is inserted until it abuts against the inner side of the back portion 40 of the front cover member 4. In the process of this insertion, the tips of the pair of claw portions 3A and 3A of the clip 3 inserted through the through holes 45 and 46 of the front cover member 4 and disposed so as to protrude in the internal space S1 abut against a front surface P1 and a back surface P2 of the holding object P, respectively.

Figure 7B:
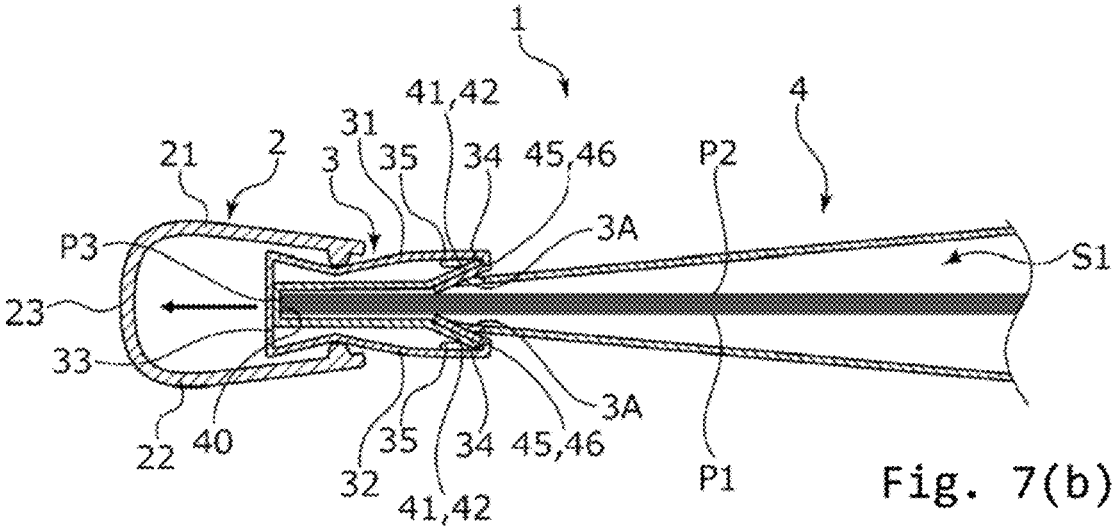
FIG. 7B is a diagram illustrating an aspect in which the holding object is inserted in the internal space of the clip and an end portion of the holding object abuts against the back end portion of the clip in the first embodiment.

Next, as illustrated in FIG. 7B, the back portion 40 of the front cover member 4 abuts against the base portion 33 of the clip 3 when the holding object P is further pushed in with the binding end portion P3 of the holding object P abutting against the back portion 40 of the front cover member 4. In the event of a further push, the clip 3 is pushed in to the base portion 23 side of the cover member 2 by the back portion 40 of the front cover member 4.

The holding pieces 31 and 32 of the clip 3 are wider than the insertion width of the cover member 2. Accordingly, the holding pieces 31 and 32 of the clip 3 are gradually stored into the cover member 2 while being elastically deformed by being compressed from the up-down direction by the pressing pieces 21 and 22 of the cover member 2. The claw portions 3A and 3A are compressed from the up-down direction by the pressing pieces 21 and 22, and thus an increase in elastic force occurs as the clip 3 is gradually stored into the cover member 2 and the holding object P is strongly held.

Figure 7C:
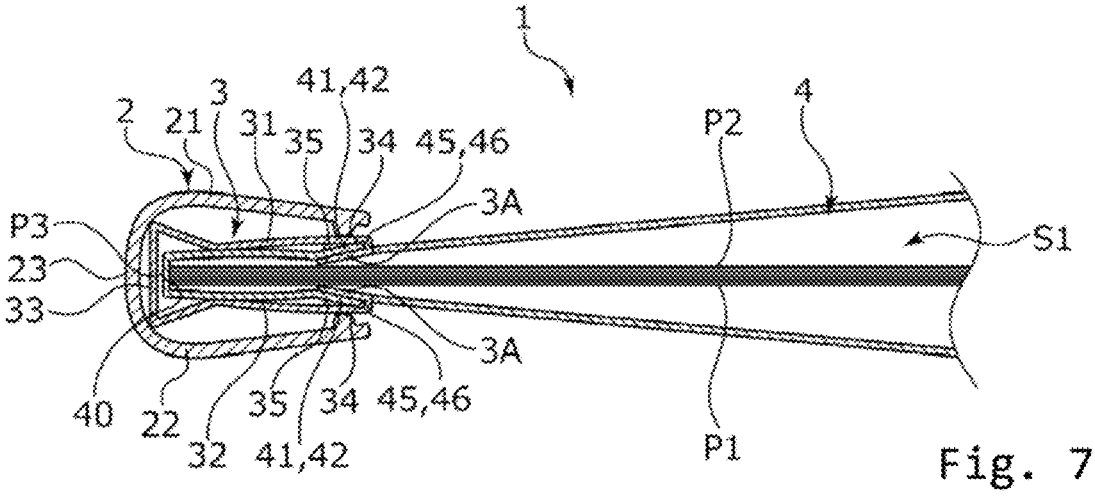
FIG. 7C is a diagram illustrating the clip that is stored in the cover member in the first embodiment.

As illustrated in FIG. 7C, the clip 3 can be inserted until the base portion 33 abuts against the base portion 23 of the cover member 2. The state where the base portion 33 of the clip 3 abuts against the base portion 23 of the cover member 2 is a state where the clip 3 is completely stored. The force of holding by the pair of claw portions 3A and 3A is maximum in this state where the binding of the holding object P by means of the binder 1 is completed. It should be noted that an aspect in which the holding object P is grasped and pushed in to the cover member 2 side during binding has been described and yet the present invention is not limited thereto and similar binding can be performed by grasping from above the front cover member 4 that covers the holding object P.

Figure 8A:
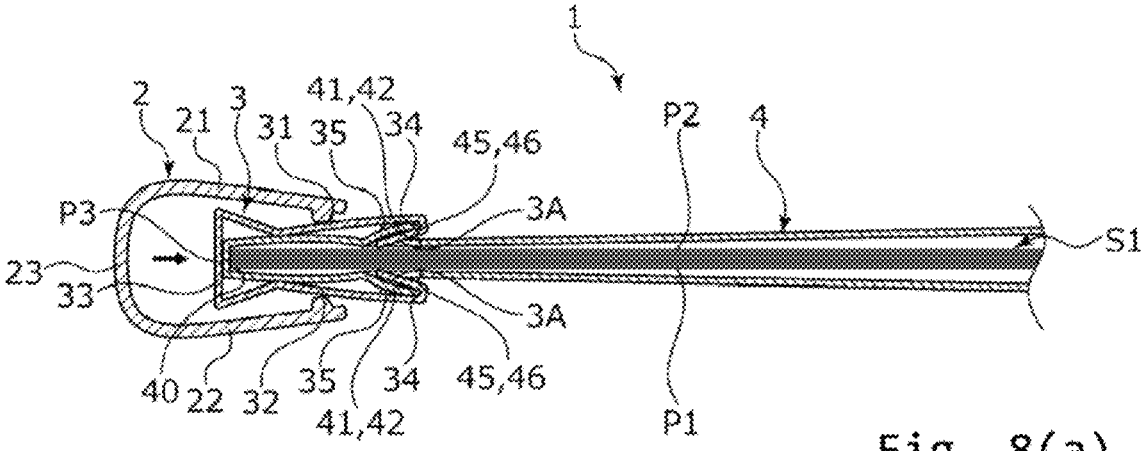
FIG. 8A is a diagram illustrating a state where the clip protrudes from the cover member to weaken the holding state of a claw portion in the first embodiment.
Figure 8B:
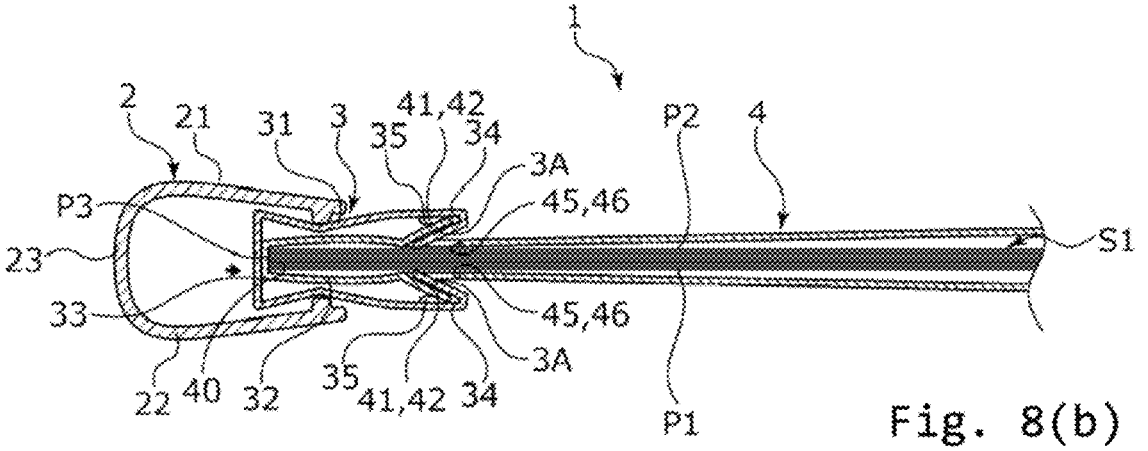
FIG. 8B is a diagram illustrating the storage release state where the clip is completely pulled out of the cover member in the first embodiment.

Next, an aspect in which the holding state of the binder 1 and the holding object P is released will be described with reference to FIGS. 8A and 8B. In removing the holding object P from the binder 1, the holding object P is grasped from above the front cover member 4 along with the vicinity of the longitudinal middle portion of the cover member 2 and a relative movement is performed in a direction of mutual separation. As a result of the relative movement in the direction of mutual separation, the frictional force caused by the tips of the pair of claw portions 3A and the front surface P1 and the back surface P2 of the holding object P causes the clip 3 to act so as to stay on the front cover member 4 side. Accordingly, the base portion 23 of the cover member 2 and the base portion 33 of the clip 3 are separated from each other and the clip 3 protrudes from the cover member 2. As a result, the claw portions 3A and 3A are put into the state that is illustrated in FIG. 8A as the compressive force received from the up-down direction of the pressing pieces 21 and 22 decreases, the elastic force is attenuated as the clip 3 is gradually pulled out of the cover member 2, and the holding force on the holding object P decreases.

Further, the front cover member 4 is moved to the front side on the holding object P when the holding object P is grasped from above the front cover member 4 and the cover member 2 and the holding object P are relatively moved in the direction of mutual separation. As illustrated in the drawing, the one side 41*b* on the tip side of the flap 41 abuts against the inner corner portion 34 of the claw portion 3A of the clip 3, and thus the front cover member 4 acts so as to pull the clip 3 out of the cover member 2. The holding force of the claw portions 3A and 3A decreases as the front cover member 4 is pulled out by the inner corner portion 34, and thus the amount of the front cover member 4 pulling the clip 3 out of the cover member 2 increases as a result of the relative movement in the direction of separation. This leads to the storage release state illustrated in FIG. 8B, where the clip 3 is completely pulled out of the cover member 2. The holding force of the claw portions 3A and 3A is minimum at this time.

Figure 9:
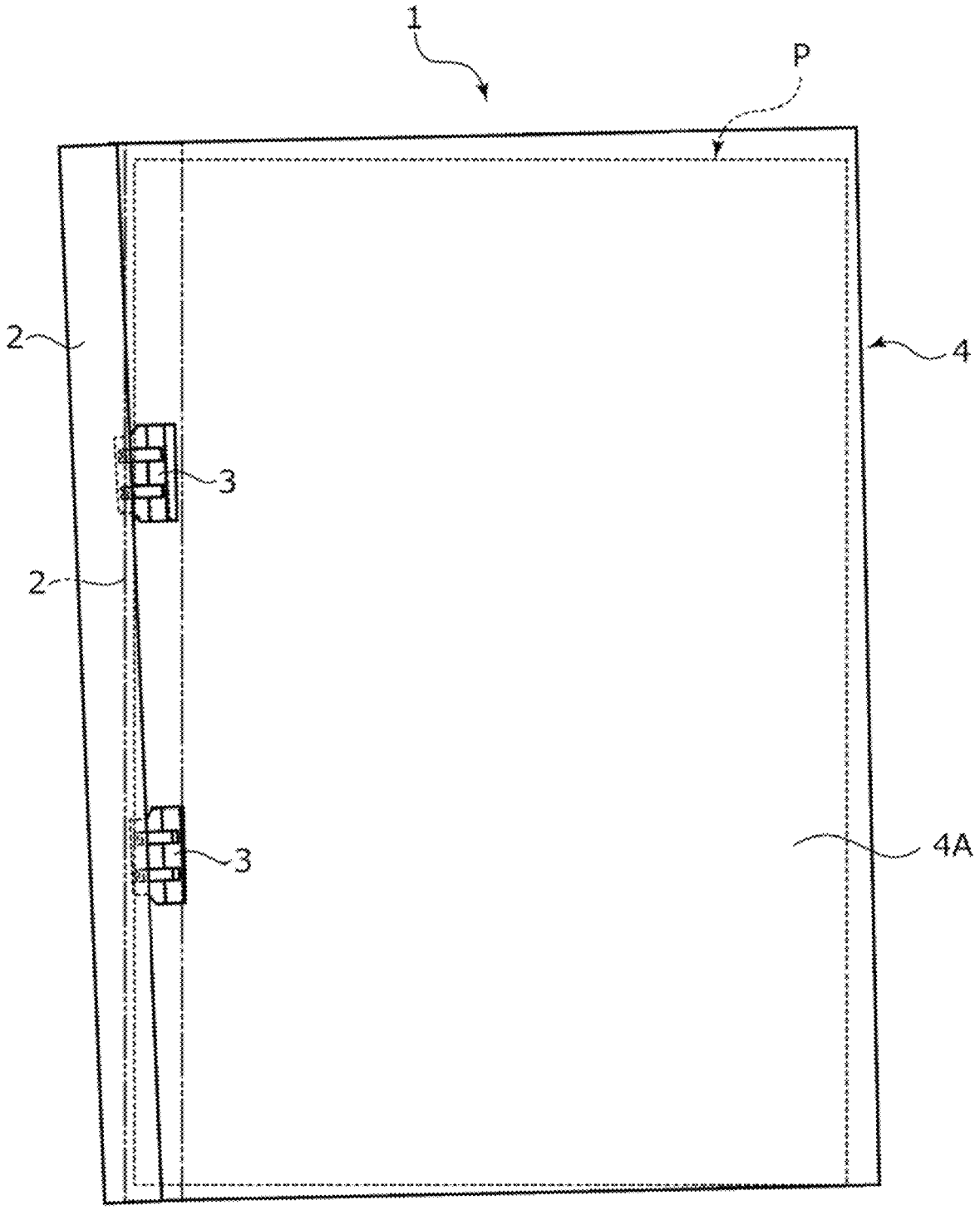
FIG. 9 is a diagram in which the cover member and a front cover portion are relatively moved in a direction in which the cover member and the front cover portion are mutually inclined and separated from each other in the first embodiment.

In removing the holding object P from the binder 1, the vicinity of the longitudinal upper end portion of the cover member 2 and the vicinity of the lower end portion of the front cover member 4 may be, for example, grasped and unintentionally moved relative to each other in a direction of mutual inclination and separation. As illustrated in FIG. 9, in such a case, the clip 3 (upper side of the paper surface) positioned on one longitudinal side away from the tilting fulcrum is moved in a direction in which the cover member 2 is separated to a large extent from the clip 3 due to friction with the holding object P, the holding force of the claw portion 3A decreases, and the clip 3 protrudes. Also in the case of the cover member 2 and the clip 3 (upper side of the paper surface) positioned on the other longitudinal side near the tilting fulcrum, the cover member 2 is formed so as to extend in the up-down direction and the clips 3 and 3 are arranged closer to the middle side than the end portion of the cover member 2. Accordingly, the clip 3 positioned on the other side is also moved in the direction of separation by following the clip 3 on one side, the holding force of the claw portion 3A decreases, and the clips 3 and 3 protrude. As a result, the holding object P can be replaced smoothly.

As described above, in the binder 1 forming a booklet by bundling the end portions of a plurality of sheets of paper such that paper addition or removal is possible, the binder 1 includes the plurality of clips 3 and the through holes 45 and 46 are formed in each of the front cover 4A and the back cover 4B of the front cover member 4 by the claw portions 3A of the plurality of clips 3 being respectively inserted. Accordingly, the claw portions 3A of the plurality of clips 3 are inserted through the through holes 45 and 46 formed in the front cover member 4 and directly abut against the front surface P1 of the paper on the uppermost surface and the back surface P2 of the paper on the lowermost surface, respectively. Accordingly, when the bundle of a plurality of sheets of paper is grasped from above the front cover and the sheet bundle and the cover member 2 are pulled so as to be separated from each other, the frictional force that acts on the point where the claw portion 3A and the holding object P abut against each other causes the cover member 2 and the plurality of clips 3 to operate so as to be relatively separated from each other without the clip 3 and the holding object P moving relative to each other. Then, the pinching pressure of the holding pieces 31 and 32 of the plurality of clips 3 is attenuated during one operation with the separation, and thus the cover member 2 and the clip 3 can be easily moved relative to each other. In addition, the plurality of clips 3 are pulled out of the opening portion of the cover member 2 and the holding force is attenuated, and thus paper can be easily re-inserted into the internal space of the clip 3. In this manner, the work of adding or removing paper bound in a booklet shape can be smoothly performed, regardless of the material of the front cover member 4, during removal and insertion alike.

In addition, in the case of new use, the clip 3 acts so as to be pulled out of the cover member 2 when the one side 41*b* and one side 42*b* on the tip side of the flip of the front cover member 4 abut against the inner corner portions 34 and 34 of the clip 3 and the cover member 2 and the front cover member 4 are relatively moved in a direction away from each other. As a result, the storage release state can be reached conveniently.

In addition, the two clips 3 are arranged near the longitudinal middle of the cover member 2 and the clip 3 is arranged near the middle of the long cover member 2. Accordingly, in a case where a bundle of a plurality of sheets of paper and the cover member 2 are inclined and pulled so as to be separated from each other, the clip 3 positioned on one longitudinal side away from the tilting fulcrum is moved so as to be separated to a large extent from the cover member 2. The clip 3 positioned on the other longitudinal side near the tilting fulcrum is also moved in the direction of separation by following the clip 3 on one side and the holding force of both clips 3 can be attenuated by one operation.

In addition, the opening width of the through holes 45 and 46 in the front-rear direction is smaller than the front-rear-direction dimension of the claw portions 3A and 3A, and thus the claw portions 3A and 3A inserted through the through holes 45 and 46 are unlikely to escape from the through holes 45 and 46.

FIGS. 10A to 10D are modification examples of the shapes of the through hole and the flap. A through hole 145 in FIG. 10A has a substantially T shape, and a flap 141 also has the same shape as the outer edge shape of the through hole 145. A through hole 146 in FIG. 10B has a substantially trapezoidal shape, and a flap 142 also has the same shape as the outer edge shape of the through hole 146. A through hole 147 in FIG. 10C has a substantially projecting shape, and a flap 143 also has the same shape as the outer edge shape of the through hole 147. In this case, parts 143*c* having a small up-down-direction dimension on the tip sides of the upper and lower edge portions of the flap 143 are locked to the locking portion 35 of the clip 3. A through hole 148 in FIG. 10D has a mountain shape having a side parallel to the tip side, and a flap 144 also has the same shape as the outer edge shape of the through hole 148. In this case, parts 144*c* having a small up-down-direction dimension on the tip sides of the upper and lower edge portions of the flap 144 are locked to the locking portion 35 of the clip 3. It should be noted that the shapes of the through hole and the flap described above are examples and any shape may be adopted insofar as a parallel side is provided in the up-down direction against the locking portion 35 of the clip 3.

Figure 11:
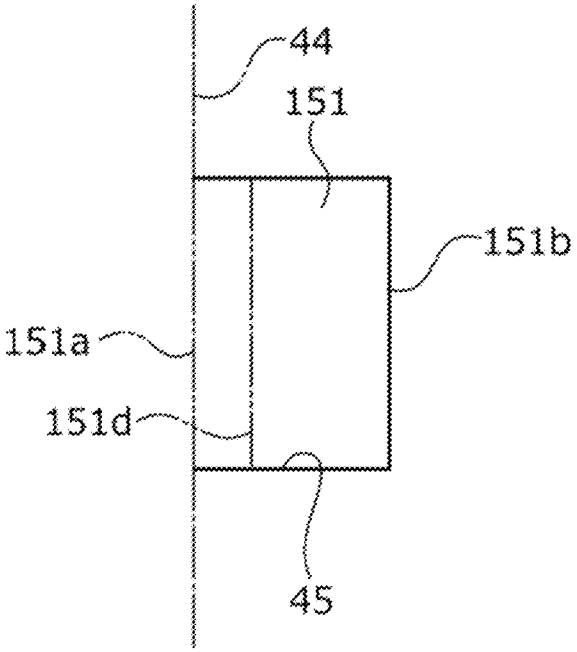
FIG. 11 is a diagram illustrating a modification example of the shape of the flap in the first embodiment.

FIG. 11 is a modification example of the shape of the flap. A flap 151 in this modification example includes a fold portion 151*d* closer to the tip side than the middle portion in the front-rear direction, that is, one side 151*a* on the back portion side. One side 151*b* on the tip side of the flap 151 is raised toward the outside by the fold portion 151*d*, the fold portion 151*d* functions as a rib, and an external force from the up-down direction of the flap 151, that is, the strength with respect to abutting against the clip 3 is increased. In addition, the fold portion 151*d* functions as a cushioning portion to improve the durability of the flap 151 with respect to the relative movement of the clip 3 and the front cover member 4, that is, the repeated insertion and removal of the holding object P. In addition, the fold portion 151*d* increases the swing and deformation allowances of the flap 151, and thus it is possible to increase the amount by which the relative movement of the clip 3 and the front cover member 4 is allowed.

Second Embodiment

Next, the binder according to a second embodiment of the present invention will be described with reference to FIGS. 12 to 15. It should be noted that configurations identical to those of the example described above will not be described below so that redundancy can be avoided.

Figure 12:
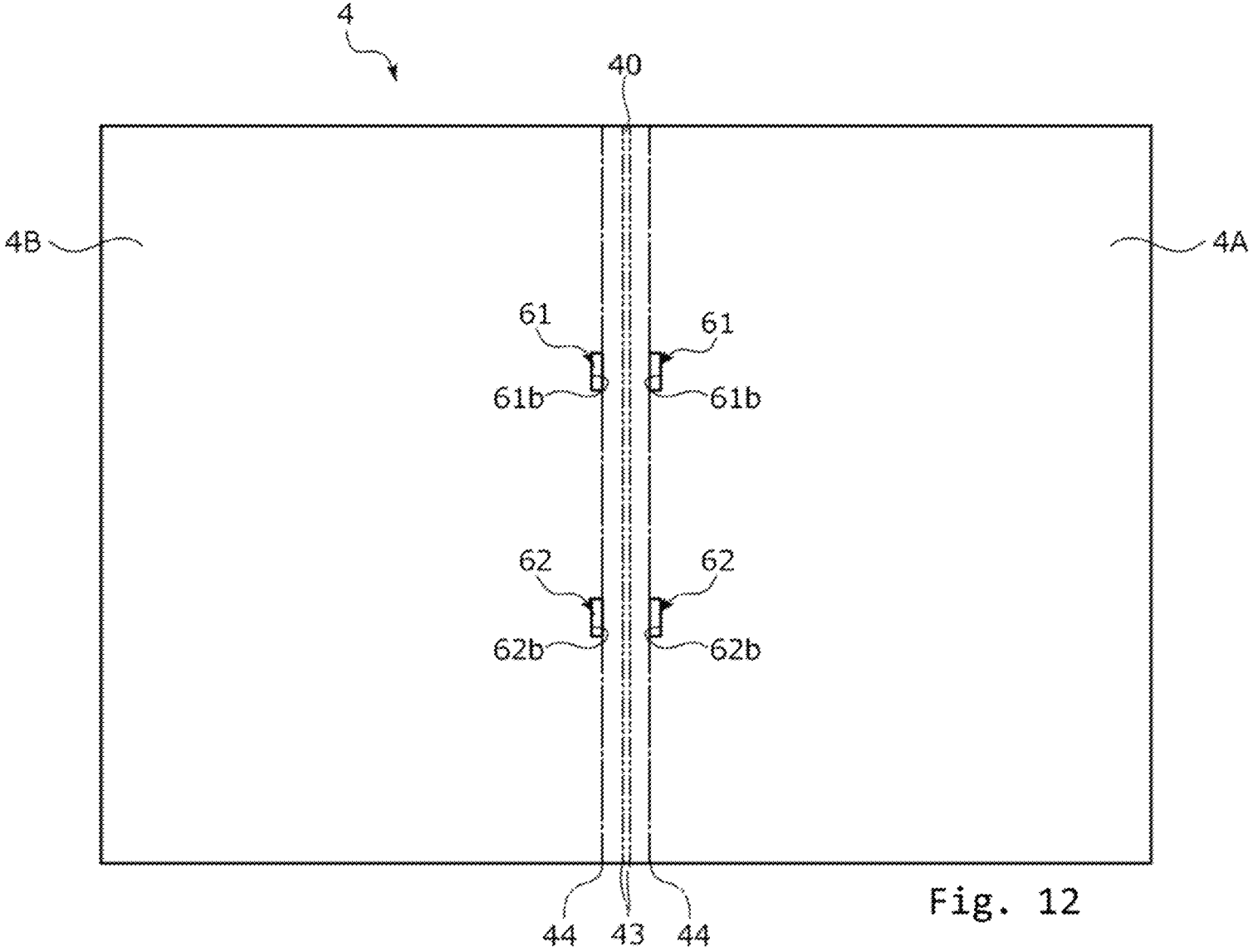
FIG. 12 is a plan view illustrating an aspect in which the front cover according to a second embodiment of the present invention is unfolded.
Figure 13A:
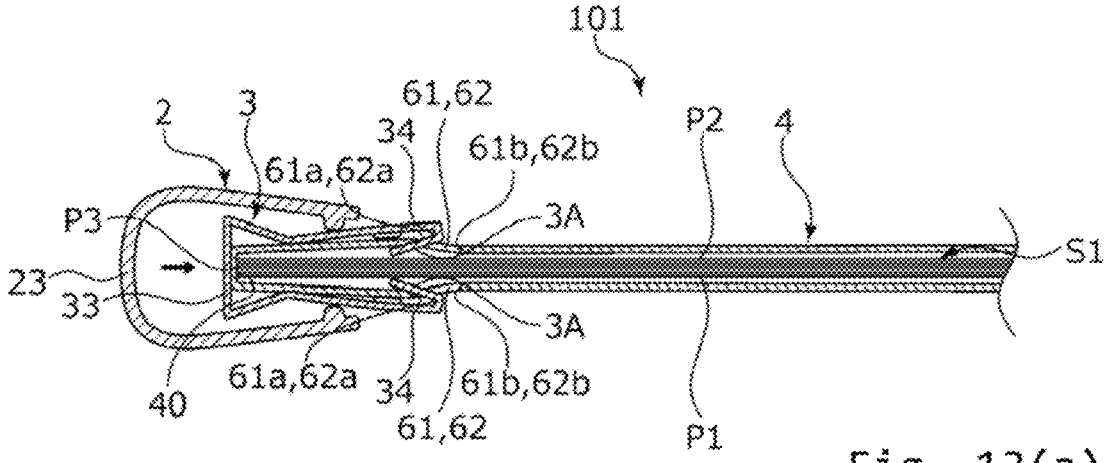
FIGS. 13A to 13C are diagrams illustrating the second embodiment.
Figure 13B:
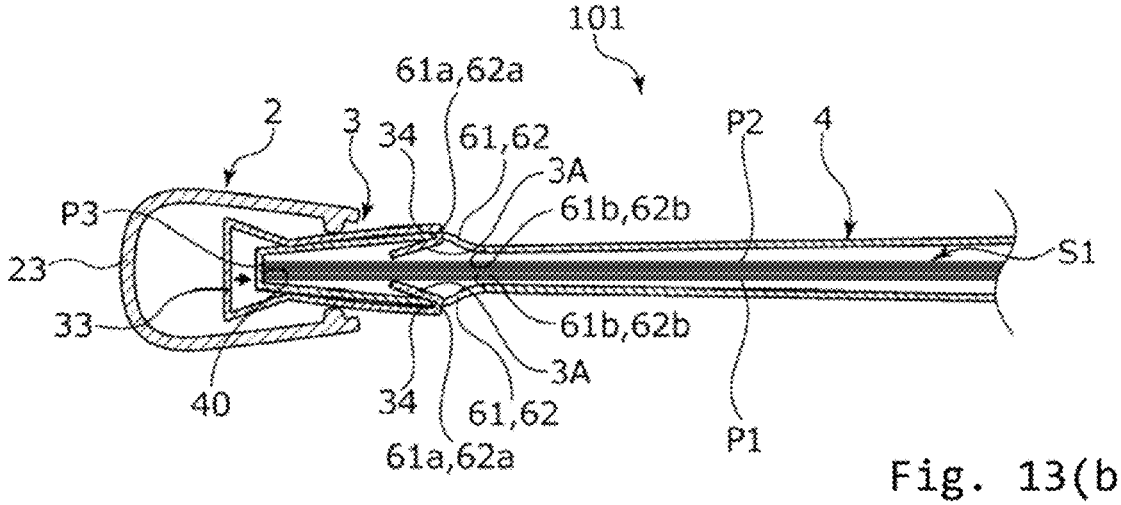

As illustrated in FIG. 12, rectangular through holes 61 and 62 are formed in the up-down direction in the front cover member 4. As illustrated in FIG. 13A, in the initial stage of holding object P removal from a binder 101, back portion-side edge portions 61*a* and 62*a* of the through holes 61 and 62 and the inner corner portion 34 formed at the boundary between the claw portions 3A and 3A are separated from each other. This is because the dimension from the back portion 40 of the front cover member 4 to the back portion-side edge portions 61*a* and 62*a* of the through holes 61 and 62 is smaller than the separation dimension to the inner corner portion 34 of the claw portion 3A from the base portion 33 of the clip 3 in the natural state.

Figure 13C:
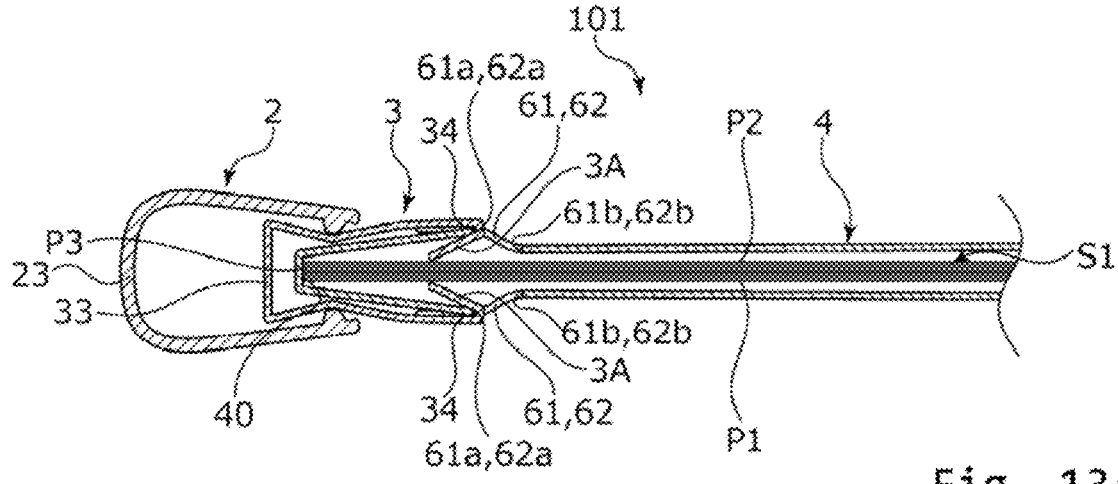

When the holding object P is grasped together with the front cover member 4 and the cover member 2 and the holding object P are relatively moved in a direction of mutual separation, the inner corner portion 34 formed at the boundary between the claw portions 3A and 3A abuts against the back portion-side edge portions 61*a* and 62*a* of the through holes 61 and 62. As illustrated in FIG. 13C, the clip 3 integrated with the front cover member 4 is pulled out of the cover member 2 when the cover member 2 and the front cover member 4 are further moved relative to each other in the direction of mutual separation with the back portion-side edge portions 61*a* and 62*a* of the front cover member 4 abutting against the inner corner portions 34 and 34 of the clip 3.

As described above, the dimension from the back portion 40 of the front cover member 4 to the back portion-side edge portions 61*a* and 62*a* of the through holes 61 and 62 is smaller than the separation dimension to the inner corner portion 34 of the claw portion 3A from the base portion 33 of the clip 3 in the natural state. Accordingly, the clip 3 is not immediately pulled out of the cover member 2 with respect to the relative movement of the front cover member 4 and the holding object P and the cover member 2 in the separation direction and the holding force of the clip 3 can be reduced to a large extent only in a case where a user removes the holding object P from the binder 101 with a clear intention.

Figure 14:
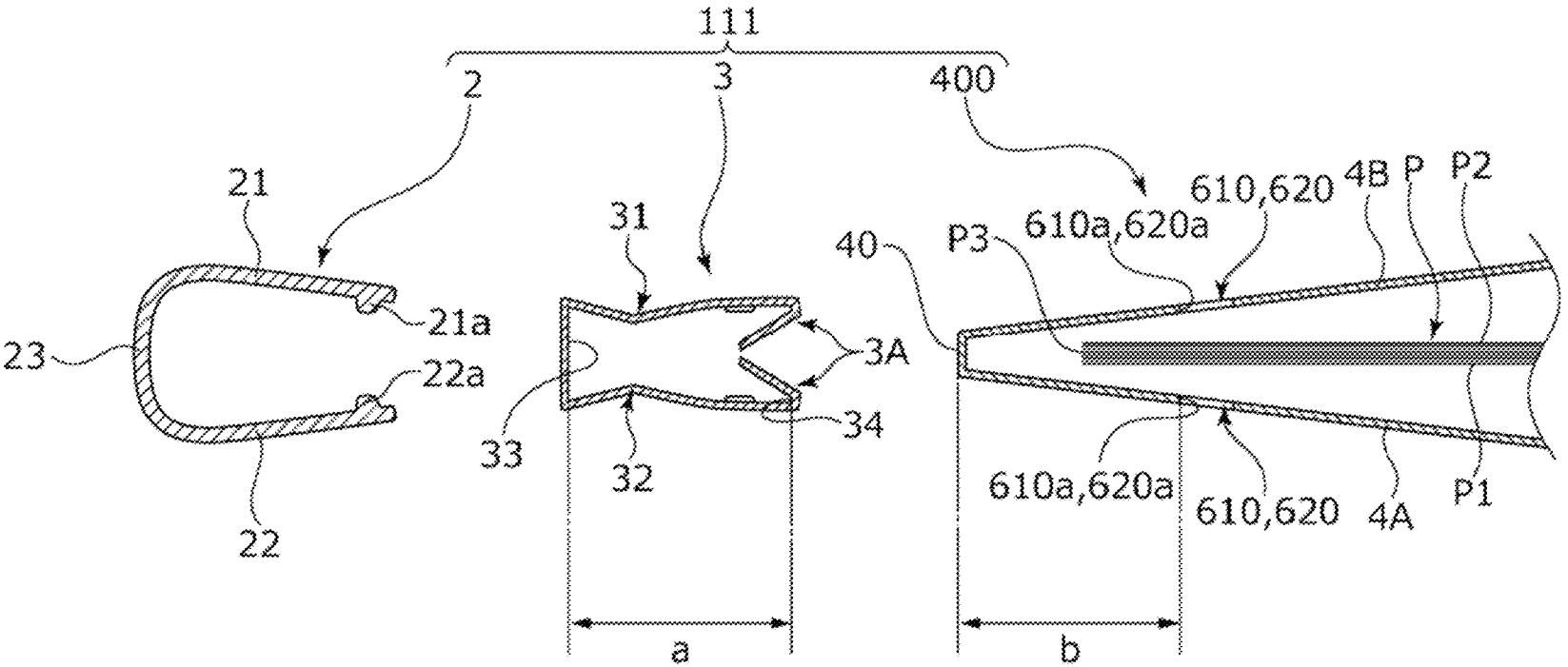
FIG. 14 illustrates the cover member and the clip in the second embodiment and the front cover member according to a modification example.

A binder 111 illustrated in FIG. 14 is a modification example in which the positions of the pair of through holes 61 and 62 are changed. As for a pair of through holes 610 and 620 of a front cover member 400 illustrated in the modification example, the distance from the outside surface of the back portion 40 of the front cover member to the back portion-side edge portion of the through hole is changed. Specifically, in this modification example, a distance b from the outside surface of the back portion 40 of the front cover member 400 to back portion-side edge portions 610*a* and 620*a* of the through holes 610 and 620 is substantially equal to a distance a from the inside surface of the base portion 33 of the clip 3 to the inner corner portion 34 folded back toward the inside surface of the claw portion 3A.

Figure 15:
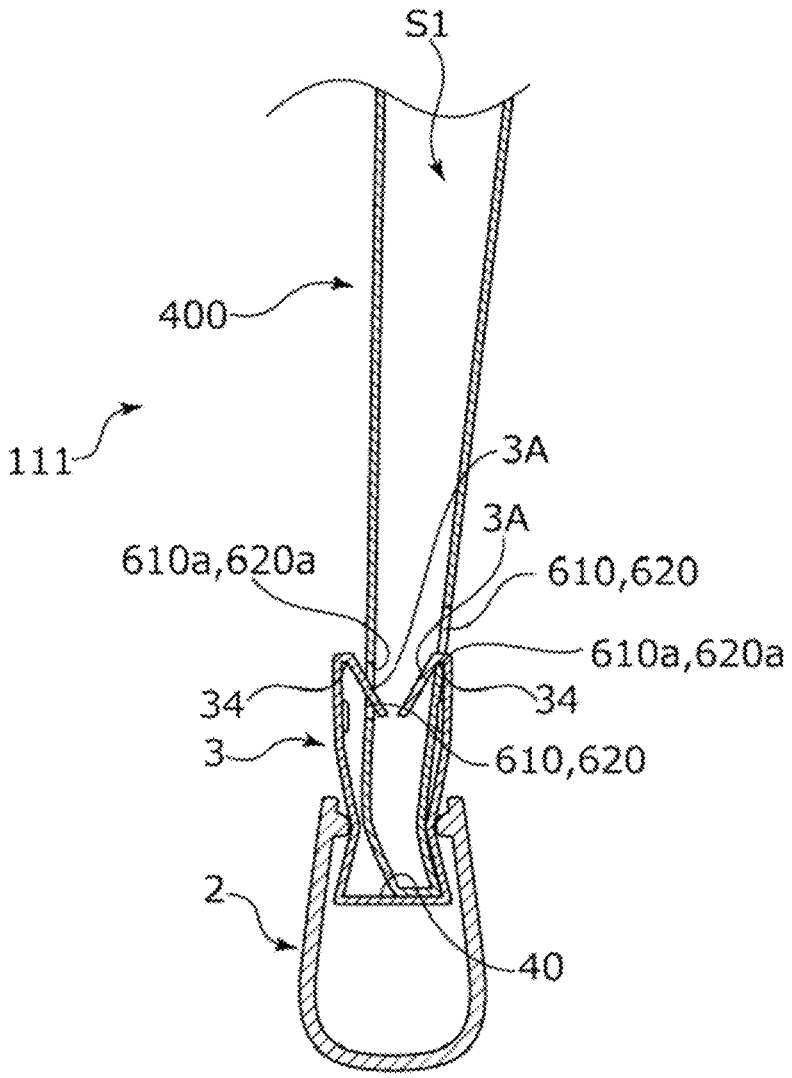
FIG. 15 is a diagram in which the front cover member according to the modification example in the second embodiment is arranged on the clip.

In attaching the front cover member 400 to the clip 3, the storage release state where the clip 3 is slid forward from the cover member 2 is reached, the claw portion 3A on one side of the clip 3 is inserted into the through hole 610 on one side formed in the front cover member 400, and the inner corner portion 34 of the claw portion 3A and the back portion-side edge portion 610*a* of the through hole 610 are caused to respectively abut. As a result, the claw portion 3A on one side of the clip 3 is engaged with the through hole 610 on one side. The front cover member 400 is formed in a deformable sheet shape. Accordingly, in engaging the claw portion 3A on the other side with the through hole 610 on the other side, it is possible to insert the claw portion 3A on the other side of the clip 3 into the through hole 610 on the other side formed in the front cover member 400 and cause the inner corner portion 34 of the claw portion 3A and the back portion-side edge portion 610*a* of the through hole 610 to respectively abut by bending the front cover member 400 on the inner side of the clip 3 as illustrated in FIG. 15.

Figure 16A:
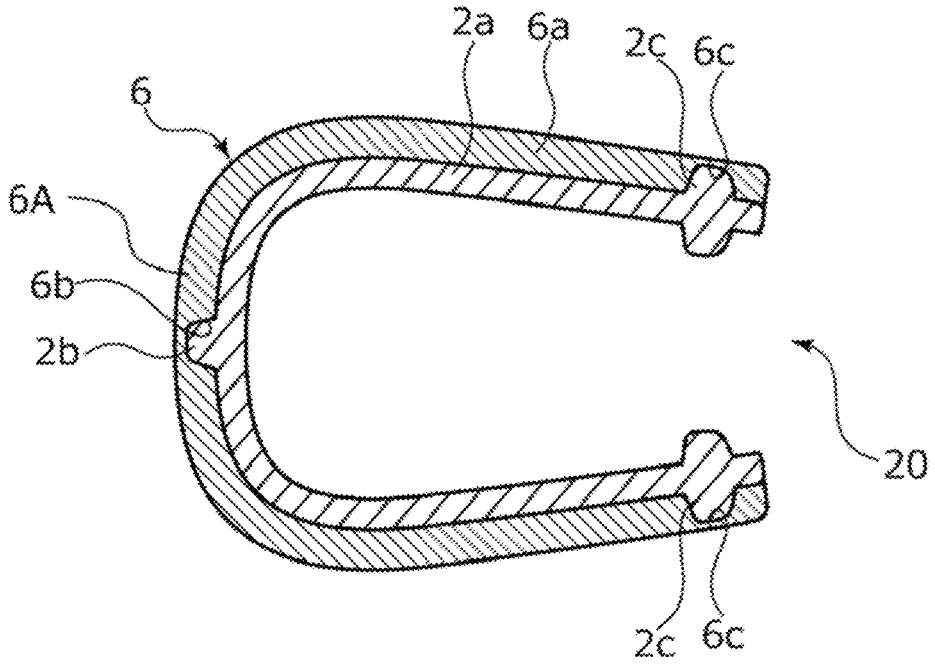
FIG. 16A illustrates a first modification example of the cover member in the second embodiment.

A first modification example of the cover member described above is illustrated in FIG. 16A. As for a cover member 20 of the first modification example, protruding portions 2*b*, 2*c*, and 2*c* extending in the up-down direction are formed on the rear end portion and both side portions of an outer surface 2*a* of the cover member 20. A decorative member 6 that can be externally fitted to the cover member 20 is detachably arranged on the cover member 20. The decorative member 6 has a substantially U-shaped cross section, extends in the up-down direction, and is formed so as to be one size larger than the cover member 20. The decorative member 6 is substantially equal in up-down-direction dimension to the cover member 20. In addition, recesses 6*b*, 6*c*, and 6*c* extending in the up-down direction are formed in the rear end portion and both side portions of an inner surface 6*a* of the decorative member 6. By the lower end portion of the decorative member 6 being caused to abut against the upper end portion of the cover member 20 and slid, the protruding portions 2*b*, 2*c*, and 2*c* and the recesses 6*b*, 6*c*, and 6*c* are engaged with each other and the decorative member 6 is externally fitted to the entire outer surface 2*a* of the cover member 20.

The decorative member 6 is formed of a synthetic resin or the like. The strength of the cover member 20 is improved by the decorative member 6 being externally fitted to the cover member 20. Further, the holding object P bound to the binder 1 is easily identified by the color or texture of the decorative member 6 being individually changed. In addition, aesthetic improvement is achieved for the binder 1 by a transparent material being used for the decorative member 6. In addition, the decorative member 6 has a display portion 6A provided by outer surface coating, seal attachment, or the like and it is possible to identify the content of the holding object P bound to the binder by describing, for example, the title and content of the holding object P in the display portion 6A. In addition, the display portion 6A of the decorative member 6 forms a flat display surface on its surface outside the outer surface of the base portion of the cover member. Accordingly, a character or the like can be easily written in the display portion 6A and identification is facilitated.

Figure 16B:
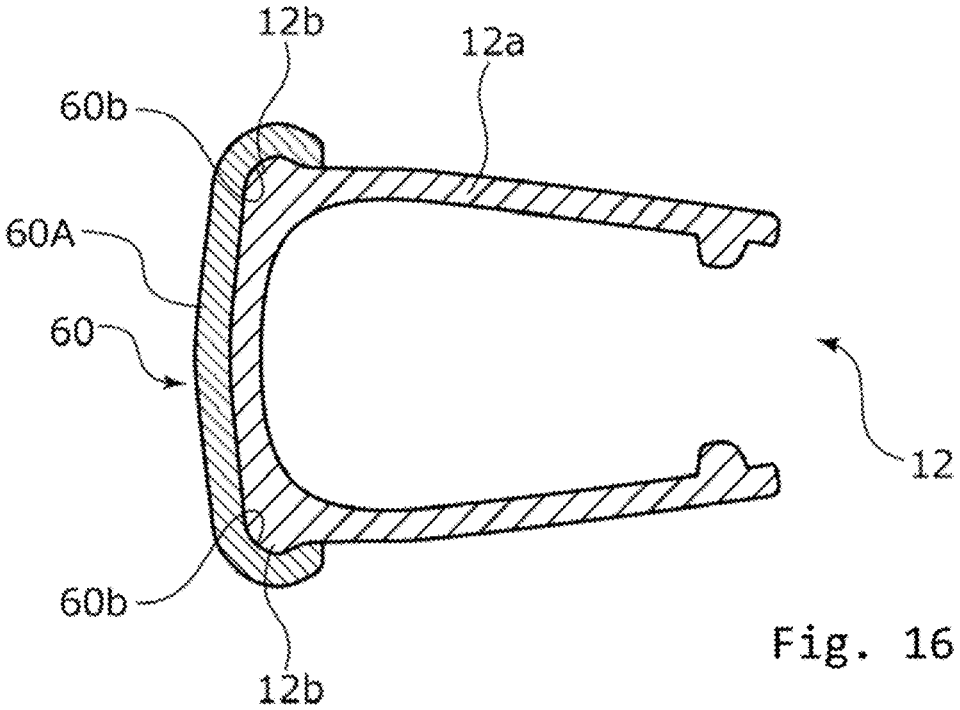
FIG. 16B illustrates a second modification example of the cover member in the second embodiment.

A second modification example of the cover member described above is illustrated in FIG. 16B. As for a cover member 12 of the second modification example, protruding portions 12*b* and 12*b* extending in the up-down direction are formed on the rear end sides of both side portions of an outer peripheral surface 12*a* of the cover member 12. A decorative member 60 that can be externally fitted to the rear end portion of the outer peripheral surface 12*a* is detachably arranged on the cover member 12. The decorative member 60 has a substantially U-shaped cross section, extends in the up-down direction, and is formed so as to be shorter in both side portions than the decorative member 6 of the first modification example. The decorative member 60 is substantially equal in up-down-direction dimension to the cover member 12. In addition, recesses 60*b* and 60*b* extending in the up-down direction are formed in the rear end portion and both side portions of the inner surface 6*a* of the decorative member 60. By the lower end portion of the decorative member 60 being caused to abut against the upper end portion of the cover member 12 and slid, the protruding portions 12*b* and 12*b* and the recesses 60*b* and 60*b* are engaged with each other and the decorative member 60 is externally fitted to the entire outer surface 2*a* of the cover member 20. In addition, since the decorative member 60 is formed so as to be shorter in both side portions than the decorative member 6, it is lightweight, easy to process, and conveniently attached to the cover member.

As described above, the decorative member 6, 60 that can be externally fitted to the cover member 20, 12 is detachably arranged on the cover member 20, 12. Accordingly, the holding object P bound to the binder is easily identified by the decorative member 6, 60 being attached to the cover member 20, 12.

Although examples and modification examples of the present invention have been described above with reference to the drawings, the specific configuration is not limited to the examples. Any changes or additions within the gist of the present invention are included in the present invention.

What is claimed is:

1. A binder forming a booklet by bundling end portions of a plurality of sheets of paper such that paper addition or removal is possible, the binder comprising:

a spread-shaped cover configured for sandwiching a bundle of the plurality of sheets of paper;

a cover member having an opening portion along a back portion of the cover, and a plurality of clips arranged so as to be configured for moving forward and backward in the opening portion of the cover member and having a pair of holding pieces and claw portions respectively extending inward from tips of the holding pieces, wherein through holes through which the claw portions of the plurality of clips are respectively inserted are formed in each of front and back covers of the cover, and wherein the cover has a flap extending toward the tips of the holding pieces from the back portion of the through hole and a locking portion protruding inward in upper and lower edge portions of the holding piece of the clip.

2. The binder according to claim 1, wherein the plurality of clips is constituted by two clips and the clips are arranged near a longitudinal middle of the cover member.

3. The binder according to claim 2, wherein a dimension from the tip to a rear end of the holding piece of the clip and a dimension from the back portion of the cover to an edge portion of the through hole are substantially equal to each other.

4. The binder according to claim 2, wherein a decorative member externally fittable to the cover member is detachably arranged on the cover member.

5. The binder according to claim 2, wherein a front-rear directional dimension of the through hole is smaller than a front-rear directional dimension of the claw portion.

6. The binder according to claim 2, wherein the flap is provided with a fold portion in a front-rear-direction middle portion.

7. The binder according to claim 1, wherein a dimension from the tip to a rear end of the holding piece of the clip and a dimension from the back portion of the cover to an edge portion of the through hole are substantially equal to each other.

8. The binder according to claim 7, wherein a decorative member externally fittable to the cover member is detachably arranged on the cover member.

9. The binder according to claim 7, wherein a front-rear directional dimension of the through hole is smaller than a front-rear directional dimension of the claw portion.

10. The binder according to claim 7, wherein the flap is provided with a fold portion in a front-rear-direction middle portion.

11. The binder according to claim 1, wherein a decorative member externally fittable to the cover member is detachably arranged on the cover member.

12. The binder according to claim 11, wherein a front-rear directional dimension of the through hole is smaller than a front-rear directional dimension of the claw portion.

13. The binder according to claim 11, wherein the flap is provided with a fold portion in a front-rear-direction middle portion.

14. The binder according to claim 1, wherein a front-rear directional dimension of the through hole is smaller than a front-rear directional dimension of the claw portion.

15. The binder according to claim 14, wherein the flap is provided with a fold portion in a front-rear-direction middle portion.

16. The binder according to claim 1, wherein the flap is provided with a fold portion in a front-rear-direction middle portion.

* * * * *